US005169327A

United States Patent [19]

Hatagishi

[11] Patent Number: 5,169,327

[45] Date of Patent: Dec. 8, 1992

[54] CONNECTOR INCLUDING CAM MEMBER OPERABLE FOR PERFORMING A FITTING OPERATION

[75] Inventor: Yuji Hatagishi, Shizuoka, Japan

[73] Assignee: Yazaki Corporation, Tokyo, Japan

[21] Appl. No.: 792,624

[22] Filed: Nov. 15, 1991

[30] Foreign Application Priority Data

Nov. 30, 1990 [JP] Japan ..... 2-329501

[51] Int. Cl.[5] ..... H01R 13/00

[52] U.S. Cl. ..... 439/157

[58] Field of Search ..... 439/152-157

[56] References Cited

U.S. PATENT DOCUMENTS 4,586,771 5/1986 Kraemer et al. .

4,902,240 2/1990 Kuzuno et al. .

FOREIGN PATENT DOCUMENTS 61-203581 9/1986 Japan .

*Primary Examiner*—Joseph H. McGlynn

*Attorney, Agent, or Firm*—Sughrue, Mion, Zinn, Macpeak & Seas

[57] ABSTRACT

An electric connector comprises: a male housing; a female housing in which the male housing is movably fitted; a cam member fitted on the female housing so that the cam member can be moved across the direction of mutual fastening of both the housings in order to fasten them each other; and a fitted state detecting member located in an engagement space defined between a fore end wall of the cam member in the movement direction of the cam member and the female housing only when both the housings are completely fitted to each other.

7 Claims, 5 Drawing Sheets

CONNECTOR INCLUDING CAM MEMBER OPERABLE FOR PERFORMING A FITTING OPERATION

BACKGROUND OF THE INVENTION

The present invention relates to an electric connector which is for electrically connecting the wires in a motor vehicle. More particularly, the present invention relates to a connector including a male housing, a female housing and a cam member operable for performing a fitting operation wherein the male housing and the female housing are fitted to each other and released from the fitting state by actuating the cam member.

FIG. 4 shows a conventional electric connector disclosed in the Japanese Patent Application (OPI) No. 61-203581/86 (the term "OPI" as used herein means an "unexamined published application") and including a female housing a, a male housing b, and a double-armed cam member c for fastening the housings to each other. Metal terminals (not shown) are received in each of the female housing a and the male housing b both of which constitute a pair of connectors.

The female housing a includes a main body $a_1$ on which guide openings $a_2$ for guiding and sliding the cam member c are formed. Driving projections $c_1$ are provided on the mutually-opposite inner surfaces of the U-shaped cam member c so as to be engaged in the guide openings $a_2$ of the female housing a and extend into the main body $a_1$.

In addition, inclined driven grooves $b_2$ extending from introduction grooves $b_1$ are formed on the mutually-opposite outer surfaces of the male housing b so that the driving projections $c_1$ are engaged with the introduction grooves $b_1$ and the inclined driven grooves $b_2$.

With such construction as mentioned above, when the female and the male housings a and b are to be fastened to each other with the cam member c, the cam member c is fitted on the female housing a and the male housing b is positioned in front of the female housing a so that the introduction groves $b_1$ of the male housing are opposed to the driving projections $c_1$ of the cam member c, as shown in FIG. 5(*a*). The male housing b is then pushed into the female housing a so that the driving projections $c_1$ are moved to the outer ends of the inclined driven grooves $b_2$ through the introduction grooves $b_1$, as shown in FIG. 5(*b*). The cam member c is then moved rightward with regard to the drawings so that the driving projection $c_1$ are moved from the outer ends of the inclined driven groove $b_2$ to the inner ends thereof to pull the male housing b deeper into the female housing a, as shown in FIG. 5(*c*). The housings a and b are thus fastened to each other using cam member c to electrically connect the metal terminals to each other.

In this conventional art, if the driving projections c1 of the cam member c fail to be moved from the outer ends of the inclined driven grooves $b_2$ of the male housing b to the inner ends of the grooves, but rather stop halfway therein, the female and the male housings a and b are incompletely fastened to each other.

SUMMARY OF THE INVENTION

The present invention has been made in order to solve the problems mentioned above.

An object of the present invention is to provide a connector including a cam member operable for performing a fitting operation wherein the fitting operation is completely performed by actuating the cam member without an occurrence of an undesirable half fitted state.

Another object of the present invention is to provide a connector including a cam member operable for performing a fitting operation wherein a pair of housings constituting the connector are completely fitted to each other without fail.

According to the present invention, there is provided an electric connector comprises: a male housing; a female housing in which the male housing is movably fitted; a cam member fitted on the female housing so that the cam member can be moved across the direction of mutual fastening of both the housings in order to fasten them each other; and a fitted state detecting member located in an engagement space defined between a fore end wall of the cam member in the movement direction of the cam member and the female housing only when both the housings are completely fitted to each other.

The fitted state detecting member is integrally projected from one wall surface of an instrument such as an electric connecting box or the like.

Usually, an engagement portion of the flexible lock arm to be engaged with an engagement portion of the fitted state confirming member is integrated with the cam member on one shorter end wall of the same. Alternatively, an engagement projection of the flexible lock arm to be engaged with the engagement portion of the fitted state confirming member may be integrated with the main body of the female housing.

According to the connector constructed in the above-described manner, the space for inserting the fitted state confirming member thereinto is not formed between the fore end wall of the cam member and the main body of the female housing, unless the cam member is moved until the female housing is completely fitted onto the male housing. Thus, at this time, insertion of the fitted state confirming member fails to be achieved. Consequently, the connector of the present invention assures that an undesirable half fitted state can be confirmed and thereby an occurrence of the half fitted state can be prevented reliably.

Other objects, features and advantages of the present invention will become apparent from reading of the following description which has been made in conjunction with the accompanying drawings.

DESCRIPTION OF THE PREFERRED EMBODIMENT

Now, the present invention will be described in detail hereinafter with reference to the accompanying drawings which illustrate a preferred embodiment of the present invention.

Figure 1:
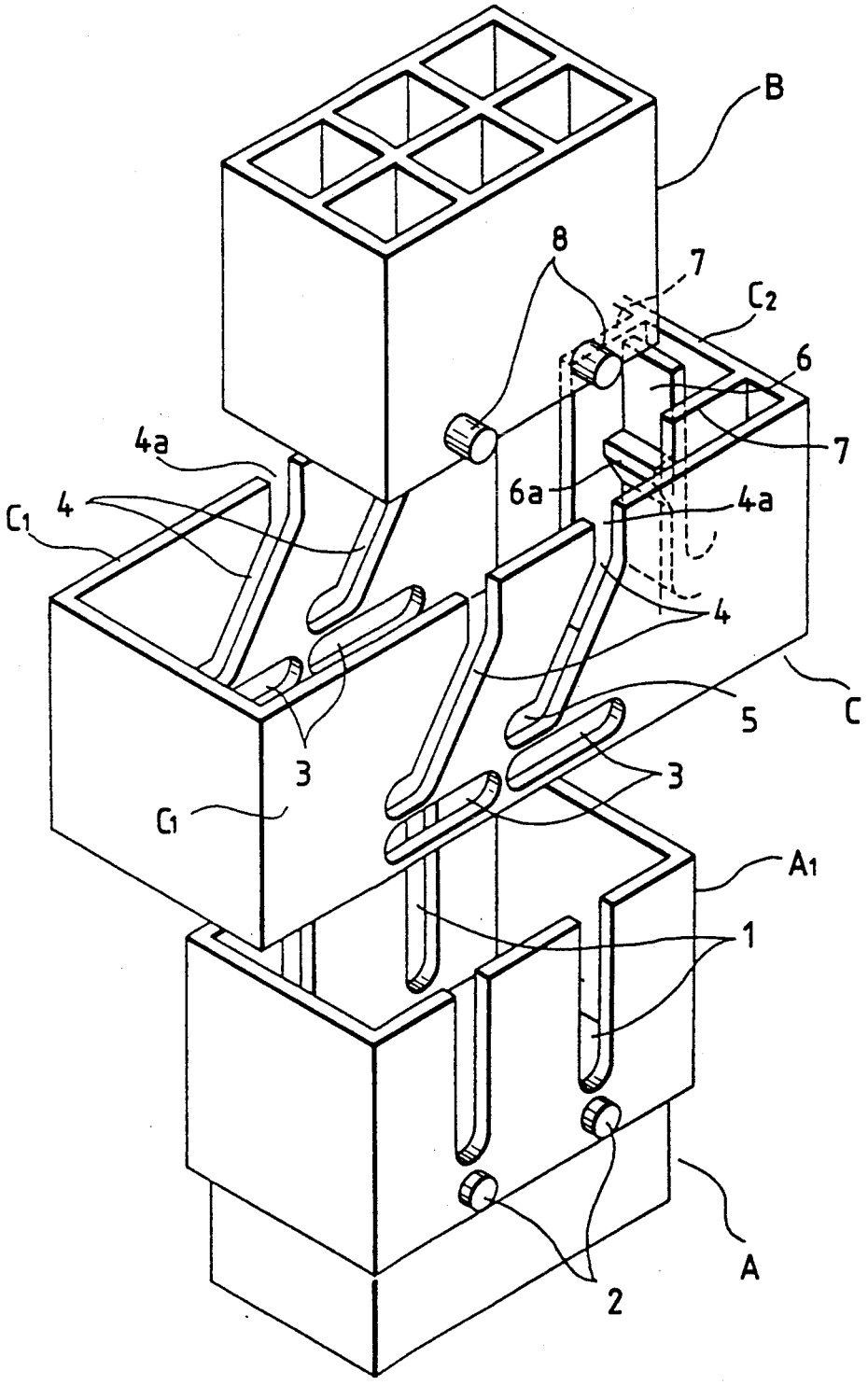
FIG. 1 is a perspective exploded view of a connector which is an embodiment of the present invention.
Figure 2:
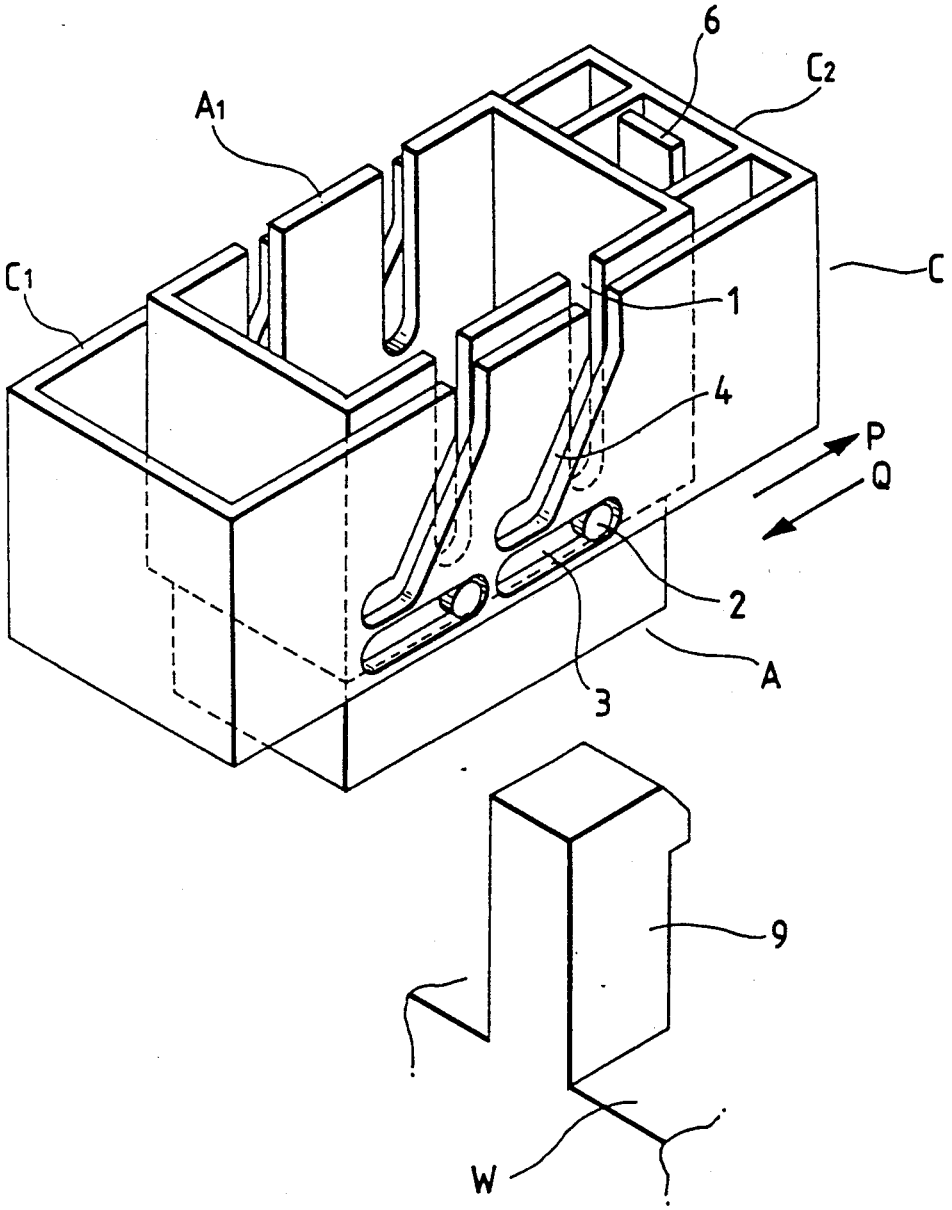
FIG. 2 is a perspective view of a female housing and the cam member both of which constitutes the connector shown in FIG. 1, particularly illustrating an assembling operation to be performed for the two members.

In FIG. 1 and FIG. 2, reference character A designates a female housing, reference character B designates a male housing and reference character C designates a rectangular frame-shaped cam member operable for fastening both the housings to each other. Metal terminals (not shown) are accommodated in the female housing A and the male housing B constituting a pair of connectors. Further, the cam member C is firmly held in a locked state by means of a fitted state detecting member 9 which is provided to be extended from one wall W of an instrument such as an electric connecting box or the like.

A pair of guide slots 1 extending in the direction of a fitting operation are formed on the mutually opposite parts of a main body $A_1$ of the female housing A. In addition, pins 2 project from the outer surfaces of the mutually opposite sides of the main body $A_1$ of the female housing A in the proximity of closed ends of the respective guide slots 1. The guide slots 1 serve to slidably receive a pair of driven pins 8, to be described later.

In addition, guide slots 3 for slidably receiving the pins 2 are formed on the lower edges of the mutually opposite longer side walls $C_1$ of the cam member C at a right angle relative to the direction of a fitting operation. Additionally, introduction slots 4*a*, inclined driving slots 4, and engagement slots 5 are also formed on the mutually opposite longer side walls $C_1$ The inclined driving slots 4 extend continuously from the introduction slots 4*a* to the engagement slots 5 which extend perpendicular to the direction of the fitting operation.

As shown in FIG. 1, a flexible lock arm 6 having an engagement projection 6*a* projecting therefrom and two fitted state confirming projections 7 with the flexible lock arm 6 interposed therebetween are formed on the inner wall surface of a right-hand shorter side wall $C_2$ of the cam member C.

A pair of driven pins 8 are projected from the mutually opposite longer side walls of the male housing B corresponding to the pins 2 on the female housing A.

As shown in FIG. 2, when the pins 2 of the female housing A are engaged with the guide slots 3 of the cam member C, the cam member C circumscribes the sheath portion $A_1$ of the female housing such that the former is movable relative to the latter in the direction of arrow P as well as in the direction of arrow Q. The direction of arrow P represents an engagement direction and the direction of Q arrow represents a disengagement direction relative to the both housings A and B.

Next, a method of detecting a fully fitted state or a half state of the female housing A relative to the male housing B will be described below with reference to FIG. 3(*a*) to FIG. 3(*c*).

Figure 3A:
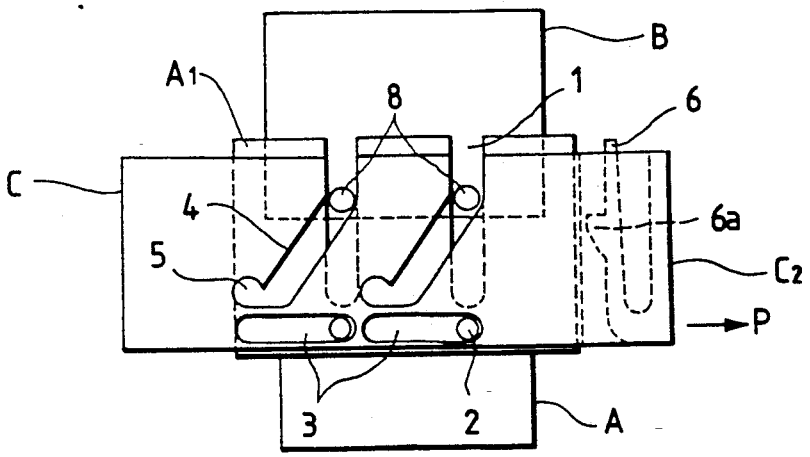
FIG. 3(*a*) to FIG. 3(*c*) are cutaway plan views of the connector to illustrate the steps of fastening and locking of the male and female housings thereof.
Figure 3B:
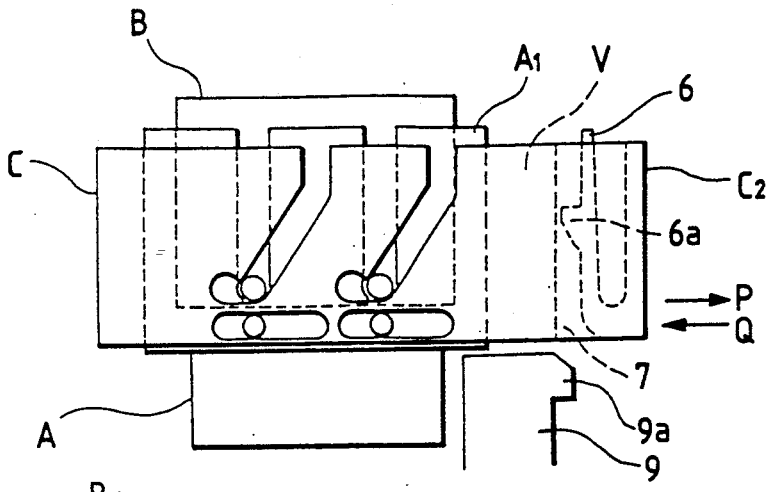
Figure 3C:
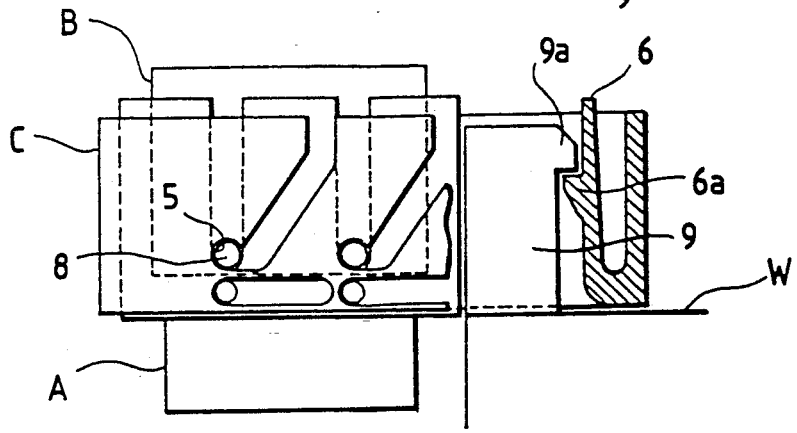
Figure 4:
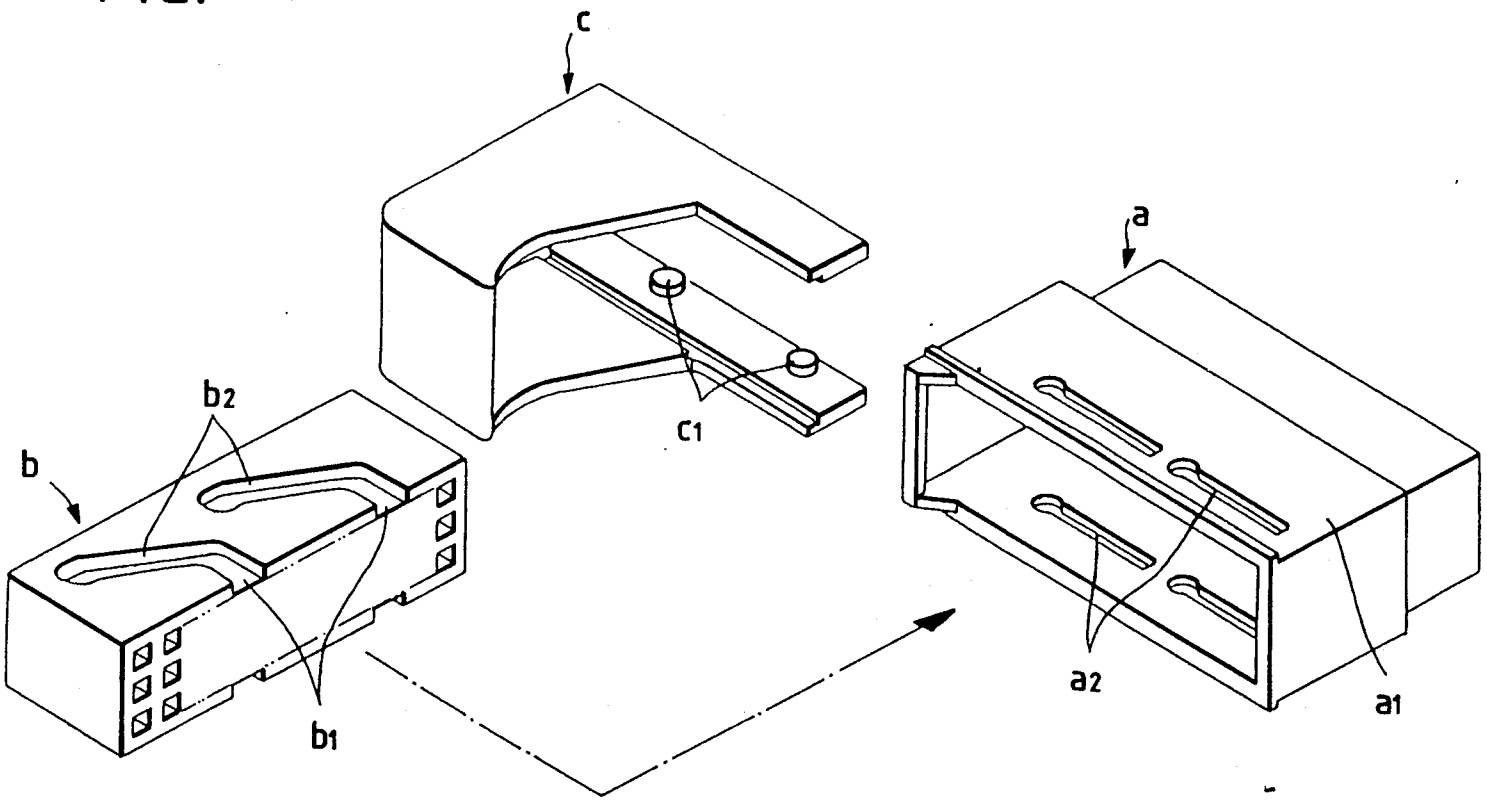
FIG. 4 is a perspective exploded view of a conventional connector.
Figure 5A:
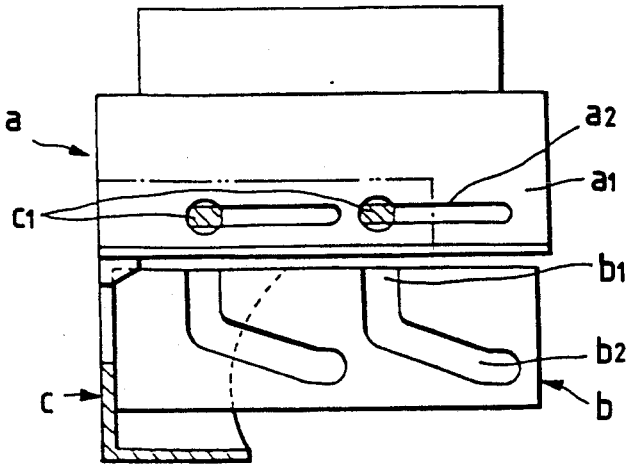
FIG. 5(*a*) to FIG. 5(*c*) are cutaway plan views of the conventional connector to illustrate the steps of fastening of the male and female housings thereof.
Figure 5B:
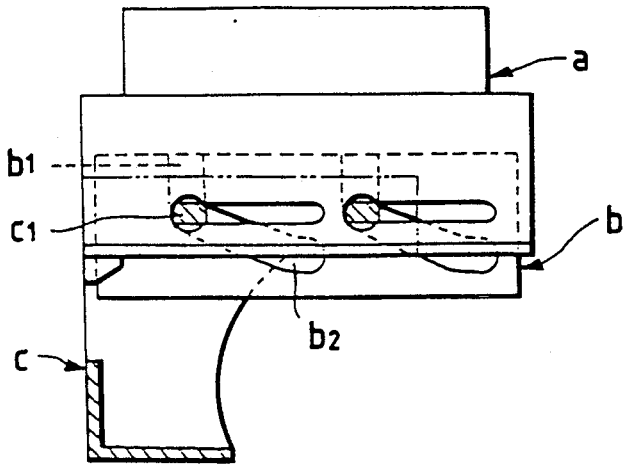
Figure 5C:
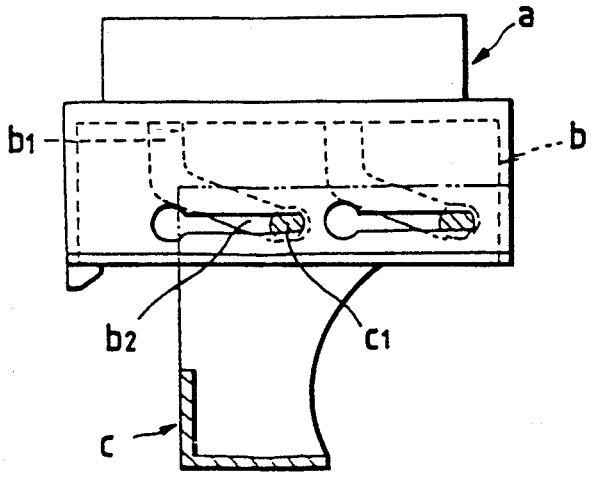

FIG. 3(*a*) is a side view of both the housings A and B illustrating the beginning of a fitting operations. At this time, the driven pins 8 on the male housing B are inserted into the guide slots 1 of the female housing A to be positioned near the beginning of the inclined driving slot 4 of the cam member C.

While the foregoing state is maintained, the cam member C is pushed to move in the direction of arrow P and the driven pins 8 are slidably displaced along the inclined driving slots 4 via the guide slots 1, causing the male housing B to be increasingly received in the main body $A_1$ of the female housing A. When the driven pins 8 reach the closed lower ends of the inclined driving slots 4, both the housings A and B are held in the partially fitted state, i.e., an undesirable half fitted state.

FIG. 3(*b*) is a side view of both the housing A and B which illustrates that they are held in the partially fitted state, i.e., an undesirable half fitted state. However, this state is unstable, because the cam member C is laterally movable in the directions of arrow P and Q. The incomplete fitting of the housings to each other is obvious because the space V, formed between the main body $A_1$ of the female housing A and the shorter side wall $C_2$ of the cam member C after completion of the aforementioned displacement, is not sufficiently wide so that the fitted state confirming projections 7 obstruct insertion of the fitted state detecting member 9. As a result, it is detected that the connector is not held immovably. In other words, both the housings A and B are incompletely fitted to each other.

When the cam member C is then pushed further in the direction of arrow P, the driven pins 8 are brought in engagement with the engagement slots 5 until a completely fitted state is locked. As a result, the space V between the female housing A and the cam member B is enlarged as illustrated in FIG. 3(*c*). This allows an engagement portion 9*a* of the fitted state confirming member 9 to be engaged with an engagement projection 6*a* of the flexible lock arm 6, resulting in the fitted state confirming member 9 being held in the locked state.

Consequently, the female housing A and the male housing B are completely fitted to each other. At the same time, the connector can firmly be secured to the wall surface W of an instrument such as an electric connecting box or the like via the fitting state confirming member 9.

The present invention has been described above with respect to the embodiment wherein the fitted state confirming member 9 is integrated with the wall surface W of the instrument such as an electric connecting box or the like but the present invention should not be limited only to this embodiment. Alternatively, an independent member such as a spacer or the like disposed separately from the wall surface W of the instrument may be substituted for the fitted state confirming member 9. Additionally, the region where the flexible lock arm 6 is arranged should not be limited only to the right-hand end wall $C_2$ of the cam member C. The flexible lock member 6 may be arranged on the main body $A_1$ side of the female housing A.

As is apparent from the above description, according to the present invention, it can reliably be prevented that both the female and male housings are connected to each other in an undesirable half fitted state. Consequently, a completely fitted state can be obtained with the connector while using the cam member operable for a fitting operations in the above-described manner.

While the present invention has been described above with respect to a single preferred embodiment thereof, it should of course be understood that the present invention should not be limited only to this but various changes or modification may be made without departure from the scope of the invention as defined by the appended claims.

What is claimed is:

1. A connector, comprising:

first and second housing each adapted to receive a plurality of electrical terminals therein;

a camming member at least partially circumscribing said housings and being engageable therewith, said camming member including at least one side wall which opposes a side wall of said first housing with a space therebetween, said camming member being moveable in a first direction with respect to said housings to attendantly move said housings toward and away from each other along a second direction substantially perpendicular to said first direction, said space increasing to a predetermined width when said camming member has moved said housings toward each other to a completely engaged position; and a detecting member insertable into said space only when the width of said space has reached said predetermined width, wherein said completely engaged position is detected by observing whether said detecting member can be inserted into said space.

2. A connector according to claim 1, wherein said detecting member is projected from a wall of an electrical connecting unit.

3. The connector of claim 1, wherein said camming member is substantially rectangular in shape, opposite side walls of said camming member, which are perpendicular to said at least one side wall, including a cam slot extending substantially diagonally with respect thereto, and wherein one of said housings includes a projection extending from opposite sides thereof and being individually engageable with said cam slots.

4. The connector of claim 3, wherein said camming member includes a transverse slot provided in said opposite side walls and extending in said first direction, and wherein the other of said housing includes a projection extending from opposite sides thereof which are individually engageable with said transverse slots.

5. The connector of claim 1, wherein said at least one side wall of said camming member includes a pair of fitted state confirming projections extending toward said housings for preventing insertion of said detecting member when said space has not reached said predetermined width.

6. A connector according to claim 5, wherein said camming member further includes:

a lock arm interposed between said fitted state confirming projections and having an engagement projection, said engagement projection being engageable with said detecting member when both said housings are in said completely engaged position.

7. A connector, comprising:

first and second housings each adapted to receive a plurality of electrical terminals therein:

camming means for moving said housings toward and away from each other, said camming means including a camming member at least partially circumscribing said housings and being engageable therewith, said camming member includes at least one side wall which opposes a side all of said first housing with a space therebetween, said camming member being moveable in a first direction with respect to said housings to attendantly move said housing toward and away from each other along a second direction substantially perpendicular to said first direction, said space increasing to a predetermined width when said camming member has moved said housings toward each other to a completely engaged position; and a detecting member insertable into said space only when the width of said space has reached said predetermined width, wherein said completely engaged position is detected by observing whether said detecting member can be inserted into said space.

* * * * *